US009309675B2

(12) United States Patent
Kvols

(10) Patent No.: US 9,309,675 B2
(45) Date of Patent: Apr. 12, 2016

(54) STAIRWAY TREAD SUPPORT DEVICE AND SYSTEM

(71) Applicant: Kelly Kristian Kvols, Colorado Springs, CO (US)

(72) Inventor: Kelly Kristian Kvols, Colorado Springs, CO (US)

( * ) Notice: Subject to any disclaimer, the term of this patent is extended or adjusted under 35 U.S.C. 154(b) by 0 days.

(21) Appl. No.: 14/474,290

(22) Filed: Sep. 1, 2014

(65) Prior Publication Data

US 2016/0060875 A1 Mar. 3, 2016

(51) Int. Cl.

| | |
|---|---|
| ***E04F 11/104*** | (2006.01) |
| ***E04F 11/025*** | (2006.01) |
| ***E04F 11/09*** | (2006.01) |
| ***E04F 21/26*** | (2006.01) |

(52) U.S. Cl.

CPC ..... *E04F 11/025* (2013.01); *E04F 11/0255* (2013.01); *E04F 11/09* (2013.01); *E04F 11/1041* (2013.01); *E04F 21/26* (2013.01)

(58) Field of Classification Search

CPC ... E04F 11/1834; E04F 21/26; E04F 11/1041; E04F 11/025; E04F 11/0255; E04F 11/09

USPC ..... 52/182, 188, 191

See application file for complete search history.

(56) References Cited

U.S. PATENT DOCUMENTS

| | | | | | |
|---|---|---|---|---|---|
| 1,189,514 | A * | 7/1916 | Wallace | 182/1 |
| 1,208,736 | A * | 12/1916 | Braun | 52/182 |
| 1,753,234 | A * | 4/1930 | Cope | 52/191 |
| 1,787,167 | A * | 12/1930 | Purdy | 403/58 |
| 2,724,466 | A * | 11/1955 | Phillips | 52/191 |
| 3,299,590 | A * | 1/1967 | Carter | 52/183 |
| 3,331,579 | A * | 7/1967 | Petersen | 249/14 |
| 3,470,664 | A * | 10/1969 | Whitehead | 52/183 |
| 4,015,687 | A * | 4/1977 | Dean | 182/220 |
| 4,148,164 | A * | 4/1979 | Humphrey | 52/94 |
| 4,527,366 | A * | 7/1985 | Greene et al. | 52/184 |
| 4,631,880 | A * | 12/1986 | Leicht | 52/105 |
| 5,636,483 | A * | 6/1997 | Wille | 52/188 |
| 6,088,977 | A * | 7/2000 | Lawrence | 52/182 |
| 6,230,454 | B1 * | 5/2001 | Meagher | 52/182 |
| 6,354,403 | B1 * | 3/2002 | Truckner et al. | 182/228.1 |
| 6,516,574 | B1 * | 2/2003 | Couture | 52/182 |
| 7,918,054 | B2 * | 4/2011 | Grafton et al. | 52/92.3 |
| 2002/0088669 | A1 * | 7/2002 | Truckner et al. | 182/228.1 |
| 2002/0124492 | A1 * | 9/2002 | Gobeil | 52/191 |
| 2003/0093959 | A1 * | 5/2003 | Couture | 52/182 |
| 2009/0205267 | A1 * | 8/2009 | Prins | 52/105 |

FOREIGN PATENT DOCUMENTS

| | | | | |
|---|---|---|---|---|
| EP | 33045 | A1 * | 8/1981 | E04F 11/02 |
| GB | 2110737 | A * | 6/1983 | E04F 11/06 |
| WO | WO 8902506 | A1 * | 3/1989 | E04F 11/02 |

* cited by examiner

*Primary Examiner* — Charles A Fox
*Assistant Examiner* — Charissa Ahmad
(74) *Attorney, Agent, or Firm* — Craig W Barber; Barber Legal

(57) ABSTRACT

A tread support device for stairways is generally triangular with two parts which pivot in relationship to one another to allow selection of any desired riser height. Precalculated groups of holes on each of the two parts overlap, with different sets of holes overlapping at different riser heights separated by different increments of ⅛ inch. An alignment guide allows easy selection of the desired riser height, after which the holes which are aligned and overlapping are fastened together to keep the device whole. A complete system consists of left-handed and right-handed tread support units, along with right and left handed units designed to meet the base of the steps with adjustable bolts. A stairway may be built using uncut stringers by use of the invention.

14 Claims, 17 Drawing Sheets

Figure 15
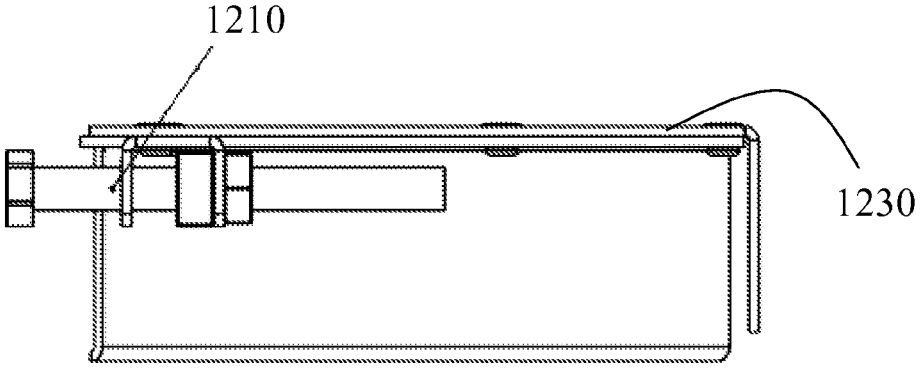
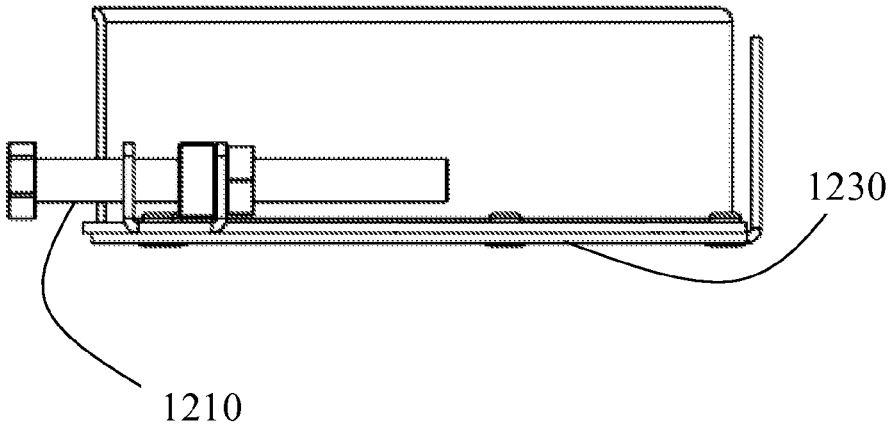
Figure 16

STAIRWAY TREAD SUPPORT DEVICE AND SYSTEM

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

CROSS-REFERENCE TO RELATED APPLICATIONS

N/A

FIELD OF THE INVENTION

This invention relates generally to stairway construction and specifically to tread supports for stairways.

STATEMENT REGARDING FEDERALLY FUNDED RESEARCH

This invention was not made under contract with an agency of the US Government, nor by any agency of the US Government.

BACKGROUND OF THE INVENTION

Construction of wooden stairs for residential use is a surprisingly painful process for the builder.

The stairs must obviously traverse a vertical height from one end to the other, however, in most instances, the horizontal run of the stairs is pre-set by an architect while the vertical height may or may not be set: outdoor patio steps, for example, will depend upon the distance from the top of the patio to the ground or landing at the lower end. Thus the builder must construct the steps within an entirely defined boundary.

Since local building codes, the Americans with Disabilities Act and other regulations and rules require that steps be of even height, that is, each step being the same height as the steps above and below it, the builder must then divide the height change into a number of even increments. For example, a height change of 8'3½" (99.5 inches) would not allow 10 steps of 10 inches each, as one step would be ½ inch short. Rather, the builder would have to calculate some reasonable number of inches per step and number of steps which "works" for the given height and is possible to do. In the given example, cutting 10 steps of 9.95 inches each is probably not possible as most construction measuring devices are denominated in units of ⅛ inch, 1/16 inch, and so on, but not 1/20 (0.05) of an inch. Rounding to the nearest ⅛ inch unit would result in the ½" deviance mentioned previously, cutting long pieces of wood on-site to within 1/16 of an inch tolerance is difficult at best and would still leave some small deviation. In this case the builder might, after some math headaches, conclude that 8 rather tall steps of 12 7/16" (12.4375"), would be difficult but at least would be even. However, under the Uniform Building Code at the present time in the US steps must be no more than 8" in height, thus sending the builder back to the math.

Obviously, this example is constructed to be very annoying to the builder, but the problem is a real one even with simpler numerical requirements.

Once the math problem has been accomplished the builder's problems are NOT over. The builder must then obtain a comparatively expensive piece of wood for the "stringer", that is, the main support beam of the stairway which runs at a diagonal from lower end to upper end, holding up all of the stairs.

A stringer is a single strong piece of wood, usually a 2×12 or the like, which under many codes must be solid wood, not composite material such as plywood or the like as composites are generally deemed unsafe for the extreme loads placed on the stairway. The stringer length much be calculated—a relatively easy issue—and normally two or more long, solid, wide, pieces of wood are bought. Depending on the stair width and length, the expense of purchasing stringers is not great but is not insignificant. Then the stringers must be cut on site.

Each step is cut individually in triangular cuts removed from the stringers, and since the treads and risers of the staircase have thickness, the previous calculations of the height of each step are now adjusted to compensate in the cutting for the treads and risers which will be part of the step.

Obviously, numerous precise cuts on an expensive piece of wood are less than desirable for the builder. The possibility of a single cut passing entirely through the stringer and thus ruining it is present, as is the possibility of a single cut which is of proper depth but misplaced so badly that the wood cannot be recut correctly and with a safe strength, requiring the reinforcement or even replacement of the stringer.

Once the stringer is cut, the stairs risers and treads may finally be fastened to it.

The strength of the stringer is dramatically reduced by the cutting: after the expense and difficulty of using a 2×12 piece of wood as the stringer, that 2×12 may well have only a 2×6 thickness remaining at its narrowest and thus weakest points—where the stairs are cut the deepest into the stringers.

It is worth considering that pre-made stairs which might be nailed or otherwise fastened to an uncut stringer would only be usable in circumstances in which the height to be traversed measures EXACTLY a multiple of the stair height. For example, pre-made steps of exactly 8 inches each would be allowable for sets of stairs which cover a rise of exactly 16 inches, 24 inches, 32 inches and so on, but would NOT be allowable for stairs which need to cover a rise of 17 inches, 23 inches, 25 inches, and so on.

It would obviously be preferable to provide a device which allows the stringer to remain whole and uncut.

It would obviously be preferable to provide a device which allows the stringer to remain whole and uncut and thus stronger.

It would obviously be preferable to provide a device which allows the stringer to remain whole and uncut and thus allow the use of narrower and thus less expensive stringers.

It would obviously be preferable to provide a device which allows the builder to avoid the exasperating mathematics necessary to bridge a given rise and run with a set of equal stairs which meet all regulatory requirements.

These and many other issues are addressed by the present invention, whose advantages, aspects, objectives and embodiments are disclosed below.

SUMMARY OF THE INVENTION

General Summary

The present invention teaches a mathematically pre-calculated tread support which is mounted upon the top edge of a stringer, the device having numerous possible riser heights available to the builder in the form of numerous choices of fastener placement. The device allows the stringer to retain full strength without being cut into and thus provides a stronger stringer of for example lumber such as 2×4, 2×6, 2×8, 2×10, 2×12, etc.

It further teaches that the tread support may have an alignment guide so that a builder, knowing the number of steps and the height to be traversed and having simply divided one by the other to obtain a stair rise, may then adjust the device to the correct rise, spot by eyeball the correct fastener placement to use, and then build the staircase without further need for calculation.

The present invention further teaches that the tread support of the bottom-most stair in a set will need to provide the proper rise, but will not have the same amount of stringer available underneath for support, and therefore the tread support must have a second configuration which can be placed in a smaller vertical space of stringer and yet be fully supported at the proper height.

The present invention further teaches that the tread support will require left-handed and right-handed embodiments, for use on the opposite ends of stair treads.

In detail, the device of the invention teaches a two part tread support having a generally triangular profile. The lower part will conform to the top and side of a diagonal stringer, regardless of the angle of the slope of the stringer, and has holes therethrough for fasteners such as screws, bolts and the like (or other fasteners as they become available) to be used to hold the support to the stringer. A fin of the lower part extends upward.

The lower part and the upper part are connected at a pivot allowing them to assume a range of angles in relation to one another. The pivot is disposed at one corner of the device, the corner where the stringer and the tread meet (and for stairs having risers, the same place where the riser bottom meets as well).

The upper part will conform to the bottom of the tread, and may have means for fastening to the tread. The fin of the lower part is coplaner and overlapping with the upper part.

The upper and lower parts each have upon them respective pluralities of holes. The groups of holes are both disposed centered at approximately the same distance from the pivot. Thus at the proper angles, various different pairs of holes of the two different groups will overlap. A fastener may be place through the holes to fix the two parts together at the chosen angle, which results in fixing the two parts together with the desired riser height.

The exact placement of the holes may be pre-calculated so that the holes will, in their various combinations of overlapping, provide numerous different heights.

In the best mode now contemplated and presently preferred embodiment, the holes will cover a span of inches with every possible adjustment from a minimum to maximum height in increments of a mere ⅛ inch. It has been determined that a group of approximately 13 to 14 holes on one part of the support, overlapping with a group of approximately 5 holes on the other part will provide this wide range. In practice, a range of over two inches may be accommodated and wider ranges are possible as well. Other increments may be used, however, ⅛ inch is a common increment of carpentry and is thus presently preferred.

An important advantage of the present invention is that an alignment guide is provided. This alignment guide allows a builder to pivot the two pieces relative to one another until the alignment guide indicates the riser height which the builder desires. At that point, the precision of the alignment guide and hole placement is such that the builder can visually see which pair of holes (one from the fin of the lower part and one from the upper part) are precisely overlapping, after which the builder may simply insert the fastener through the desired pair of holes, fastening the tread support in the proper configuration. A rivet is presently preferred for the fastener, due to strength, but any fastener now known or later developed may of course be used if issues of strength, durability and regulations may be addressed.

For additional strength, each unit has thereon not two but five groups of holes, so that with one unit at each end of a tread, the tread is supported by seven fasteners at one end and the pivot point (also preferably a rivet) at the other end, making a total of eight fasteners holding up the end of the step or tread. Obviously additional fastening groups may be provided for even more support.

SUMMARY IN REFERENCE TO CLAIMS

It is therefore another aspect, advantage, objective and embodiment of the invention, in addition to those discussed previously, to provide a stairway tread support device for use on a stringer of a set of stairs, the stringer having a top and a side, the tread support device for use supporting a level tread, the tread support device comprising:

a pivot point;

a first lower part, the lower part having a vertical fin;

a second upper part, the upper part and the lower part pivoting relative to one another about the pivot point;

a first riser height H measured at a first edge of the device distal from the pivot point, the riser height H having a plurality of values;

a first plurality of holes passing through the fin of the lower part, the first plurality of holes centered at a first distance from the pivot point;

a second plurality of holes passing through the upper part, the second plurality of holes also centered at the first distance from the pivot point;

a first pair of holes including a first hole of the first plurality of holes and a second hole of the second plurality of holes which are overlapping when the riser height H is a first riser height $H_1$;

the first and second plurality of holes arranged so that as the riser height H increases by a first increment X from $H_1$ to a riser height $H_2$, the first pair of holes are no longer overlapping and a second pair of holes including a third hole of the first plurality of holes and a fourth hole of the second plurality of holes do overlap;

a fastener dimensioned and configured to pass through the overlapping pairs of holes and disposed within an overlapping pair of holes.

It is therefore another aspect, advantage, objective and embodiment of the invention, in addition to those discussed previously, to provide a set of stairs including the tread support device of claim 1, the set of stairs further comprising:

an uncut stringer, the stringer supported at a first end and at a second end, the first end higher than the second end, the stringer having a top surface disposed at an angle due to the first end being supported higher than the second end;

the tread support device disposed upon the top surface, the first lower part fastened to the stringer, the fastener disposed through the first pair of holes such that the riser height H has the value $H_1$;

a tread, the tread disposed upon the second upper part of the tread support device, the tread fastened to the second upper part.

It is therefore another aspect, advantage, objective and embodiment of the invention, in addition to those discussed previously, to provide a stairway tread support device wherein the increment X is ⅛ inch (3 mm).

It is therefore another aspect, advantage, objective and embodiment of the invention, in addition to those discussed previously, to provide a stairway tread support device further comprising:

a second tread support device, the second tread support device having a second tread support device pivot point;

a second tread support device lower part, the second tread support device lower part having a second tread support device vertical fin;

a second tread support device upper part, the second tread support device upper part and the second tread support device lower part pivoting relative to one another about the second tread support device pivot point;

a second tread support device first riser height H measured at a second tread support device second edge distal from the second tread support device pivot point, the second tread support device riser height H having a plurality of values;

a second tread support device first plurality of holes passing through the second tread support device fin of the second tread support device lower part, the second tread support device first plurality of holes centered at a second tread support device first distance from the second tread support device pivot point;

a second tread support device second plurality of holes passing through the second tread support device upper part, the second tread support device second plurality of holes also centered at the first distance from the second tread support device pivot point;

a third pair of holes including a fifth hole of the second tread support device first plurality of holes and a sixth hole of the second tread support device second plurality of holes which are overlapping when the second tread support device riser height H is the first riser height $H_1$;

the second tread support device first and second plurality of holes arranged so that as the second tread support device riser height H increases by the first increment X from $H_1$ to the riser height $H_2$, the third pair of holes are no longer overlapping and a fourth pair of holes including a seventh hole of the second tread support device first plurality of holes and an eighth hole of the second tread support device second plurality of holes do overlap;

a second fastener dimensioned and configured to pass through the overlapping pairs of holes of the second tread support device and disposed within an overlapping pair of holes;

the second tread support device further comprising:

a height adjustment mechanism separate from the pluralities of holes, the height adjustment mechanism providing a second independent adjustment to the riser height H of the second tread support device, the height adjustment mechanism located on the second tread support device second edge;

the second edge being shorter than the first edge.

It is therefore another aspect, advantage, objective and embodiment of the invention, in addition to those discussed previously, to provide a stairway tread support device wherein the height adjustment mechanism further comprises:

a bolt, secured to the second tread support device second edge with the bolt parallel to the second edge, whereby a bottom step is additionally supported.

It is therefore another aspect, advantage, objective and embodiment of the invention, in addition to those discussed previously, to provide a stairway tread support device wherein the bolt is secured to the second edge by passing through a bracket attached to the second tread support device lower part, the bolt passing through a bracket nut attached to the bracket and further passing through a jam nut.

It is therefore another aspect, advantage, objective and embodiment of the invention, in addition to those discussed previously, to provide a stairway tread support device wherein the second plurality of holes on the upper part are arranged in a first pivot line, the first pivot line passing through the pivot point, while the first plurality of holes on the lower part are arranged in a group, the group deviating from the first pivot line.

It is therefore another aspect, advantage, objective and embodiment of the invention, in addition to those discussed previously, to provide a stairway tread support device wherein the pivot point further comprises: a rivet.

It is therefore another aspect, advantage, objective and embodiment of the invention, in addition to those discussed previously, to provide a stairway tread support device wherein the fastener further comprises: a rivet.

It is therefore another aspect, advantage, objective and embodiment of the invention, in addition to those discussed previously, to provide a stairway tread support device wherein the first edge further comprises:

an alignment guide, the alignment guide having a series of markings, the series of markings bearing indicia indicating the value of the riser heights $H_1$ and $H_2$, measured to the nearest increment X.

It is therefore another aspect, advantage, objective and embodiment of the invention, in addition to those discussed previously, to provide a stairway tread support device wherein the alignment guide is sufficient accurate that when riser height $H_1$ is indicated, the overlap of the first and second holes is visible and the first and second holes overlap, and when riser height $H_2$ is indicated, the overlap of the third and fourth holes is visible and the third and fourth holes overlap;

whereby the overlap is sufficiently accurate that the fastener may pass through the visibly overlapping holes.

It is therefore another aspect, advantage, objective and embodiment of the invention, in addition to those discussed previously, to provide a stairway tread support device wherein the lower part further comprises a flat-to-stringer-support portion, the flat-to-stringer-support portion disposed upon such stringer top.

It is therefore another aspect, advantage, objective and embodiment of the invention, in addition to those discussed previously, to provide a stairway tread support device wherein the lower part further comprises a side-of-stringer-support portion, the side-to-stringer-support portion disposed upon such stringer side.

It is therefore another aspect, advantage, objective and embodiment of the invention, in addition to those discussed previously, to provide a stairway tread support device wherein the flat-to-stringer-support portion further comprises: a fastening hole allowing fastening of the tread support device to such stringer.

It is therefore another aspect, advantage, objective and embodiment of the invention, in addition to those discussed previously, to provide a stairway tread support device wherein the upper portion further comprises a tread support part, the tread support part having such tread disposed thereon and fastened thereto.

It is therefore another aspect, advantage, objective and embodiment of the invention, in addition to those discussed previously, to provide a system for fastening treads to stringers and supporting the treads, the system comprising:

a first tread support device of claim 1 having a left-handed orientation;

a second tread support device of claim 1 having a right-handed orientation;

a third tread support device of claim 6 having a left-handed orientation;

a fourth tread support device of claim 6 having a right-handed orientation.

BRIEF DESCRIPTION OF THE DRAWINGS

FIG. 15 is a front view of the second embodiment of the invention, left-handed.

FIG. 16 is a side view of the second embodiment of the invention, right-handed.

INDEX TO REFERENCE NUMERALS

Figure 1:
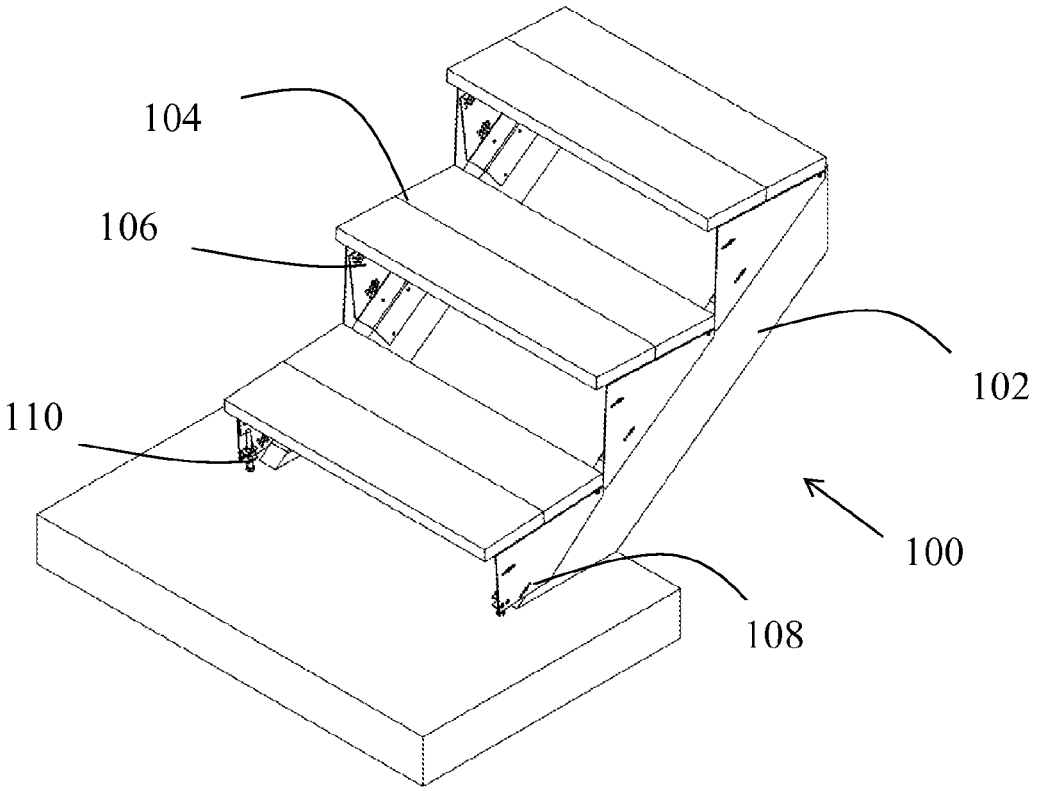
FIG. 1 is an elevational oblique view of a first and a second embodiment of the device in use on a set of stairs.

Stairs 100
Stringer 102
Tread 104
Tread support device 106
Bottom tread support 108
Bottom bolt 110
Stairs 200
Stringer 202
Tread 204
Tread support 206
Bottom tread support 208
Bottom bolt 210
Tread support upper portion 212
Tread support lower portion 214
Adjustable height device 216
Stairs 300
Tread 304
Tread support 306
Bottom tread support 308
Bottom bolt 310
Bottom bolt 410
Bottom bolt bracket 420
Bracket nut 422
Jam nut 424
Tread support (right) 506
Tread support upper portion 530
Tread support lower portion 532
Flat to stringer support 534
Side of stringer support 536
Fin 538
Flat to tread support 540
Fin holes group 1 (on lower portion) 542
Fin holes group 2 (on lower portion) 544
Pivot 546
Pivot hole 1 (w/ rivet) 546*a*
Pivot hole 2 (w/ rivet) 546*b*
Upper portion holes group 1 548
Upper portion holes group 2 550
Fastener (rivet) 552
Fastener (rivet) 554
Alignment scale 556
Fastening point 572
Tread support (bottom step) 1208
Bottom bolt 1210
Bottom bolt bracket 1220
Bracket nut (square) 1222
Jam nut 1224
Tread support upper portion 1230
Tread support lower portion 1232
Flat to stringer support 1234
Side of stringer support 1236
Flat to tread support 1240
Fin holes group 1 (lower portion holes) 1242
Pivot (w/ rivet) 1246
Pivot hole 1 (w/ rivet) 1246*a*
Upper portion holes group 1 1248
Upper portion holes group 2 1250
Fastener (rivet) 1252
Fastener (rivet) 1270
Fastener hole 1 1270*a*
Fastening point 1272
Partially occluded hole 1274

DETAILED DESCRIPTION

In the presently preferred embodiment and best mode now contemplated for carrying out the invention, the invention is a generally triangular tread support which has overlapping upper and lower portions which may pivot in relation to one another. By pivoting the halves, the value of the riser height may be adjusted up and down, by reference to an alignment guide the correct pair of holes among two pluralities of overlapping holes, one group on each part, may be chosen and secured together to maintain the desired riser height. The device of the invention in a presently preferred embodiment and best mode now contemplated may change height from 6.5" to 8" inches (16.5 cm to 20.32 cm) in height in accordance with the ADA and Uniform Building Code. However, it is not so limited, for example in jurisdictions which have different laws, or should US standards change, the device may adjust to virtually any range of heights by recalculation of hole locations.

FIG. 1 is an elevational oblique view of a first and a second embodiment of the device in use on a set of stairs. Stairs 100 have stringer 102 (one of two such), which is a sturdy diagonal member of wood or the like and which serves as the main support of the stairs. Tread 104 may be seen, while the risers have been omitted from the diagrams for the sake of clarity.

Tread support device 106 is seen mounted on the top edge of a stringer, one of six in use: four are similar and are triangular, while bottom tread support 108 and it's matching companion are only approximately triangular, since they must provide space (one corner is clipped off) to make up for the fact that the stringer 102 does not extend all the way to the end of the bottom-most tread. To make up for the lack of support, bottom bolt 110 is provided.

It will be immediately seen that both of the types have two sub-types: left and right handed. One type goes onto the left stringer and one type goes onto the right. Note that the actual designation as to which is "left" or "right" is made looking from the bottom of the the stairs to determine the left and right, however one type must fit on a left stringer and one type fits onto a right stringer.

Figure 2:
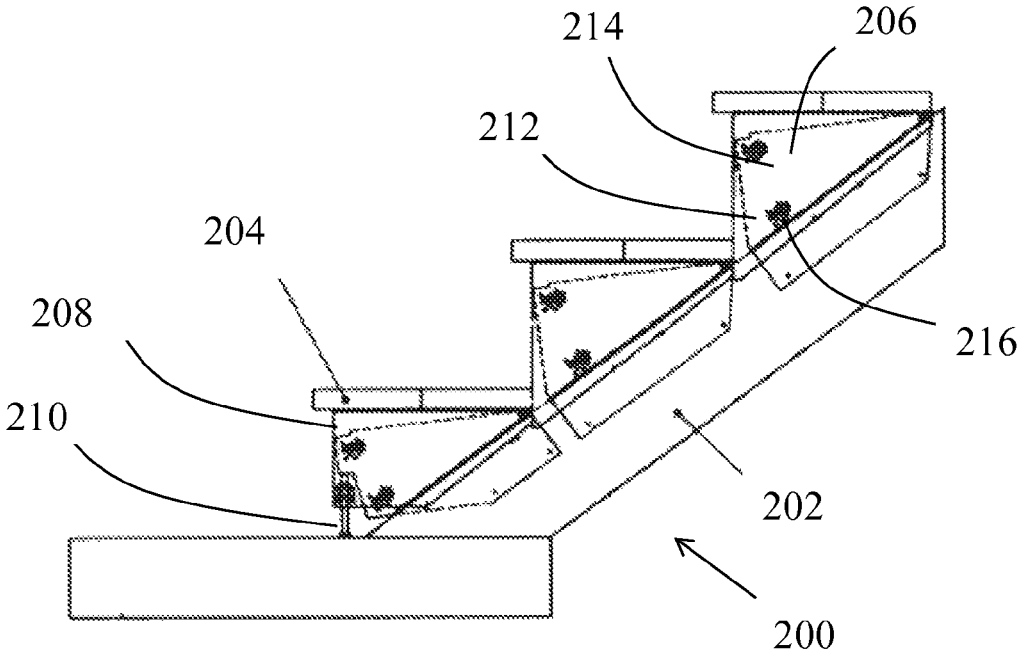
FIG. 2 is a transparent side view diagram of a first and second embodiment of the device, in use on a set of stairs.

FIG. 2 is a transparent side view diagram of a first and second embodiment of the device, in use on a set of stairs. Stairs 200 have stringer 202 visible.

It will be immediately noted that stringer 202, like stringer 102, is not cut.

An uncut stringer is stronger than a stringer made of the same size of wood but cut: the cuts narrow a stringer and weaken it. Thus, the uncut stringer is one important feature and advantage of the present invention. Tread 204 may be seen. It may be made of materials such as TREX® brand material, wood, polymers, composites and the like.

Tread support 206 is seen in transparency, with the tread support lower portion 214 behind the tread support upper portion 212 and the stringer 202. The upper and lower portions 212/214 are not identical, nor are they strictly overlapping, rather they are angled a bit in relationship to one another. As they are installed, they are fixed into angular relationship and are no longer free to pivot.

Bottom tread support 208 may be seen to have the clipped corner (not actually clipped during manufacture, the expression is used to describe the fact that one corner of the triangle is not manufactured), which is necessary as it will be seen that stringer 202 runs under the full length of the stairs higher up but only under part of the length of the lowest stair, in addition to the lowest stair having no depth of a riser below it. Thus, the bottom unit must be able to cope with different conditions from all the other units and yet provide the same rise, and thus adjustable bottom bolt 210 is provided.

Adjustable height device 216 (which is different from the overall unit) is seen but is clearer in later diagrams: this part of the tread support allows the overall adjustment of heights on all the steps, not just on the bottommost step. This part of the invention, the adjustment device, 216, is seen to comprise two sets of holes on two different portions of the device, the holes overlapping in a number of configurations which allow different heights to be maintained, and a fastener which may pass through the selected pair of holes. One unit of the invention may have a plurality of such height adjustment devices 216 thereon: in the presently preferred embodiments the number is four, however, more may be used for extra support or fewer may be used if it may be safely accomplished, all within the scope of the present invention.

Figure 3:
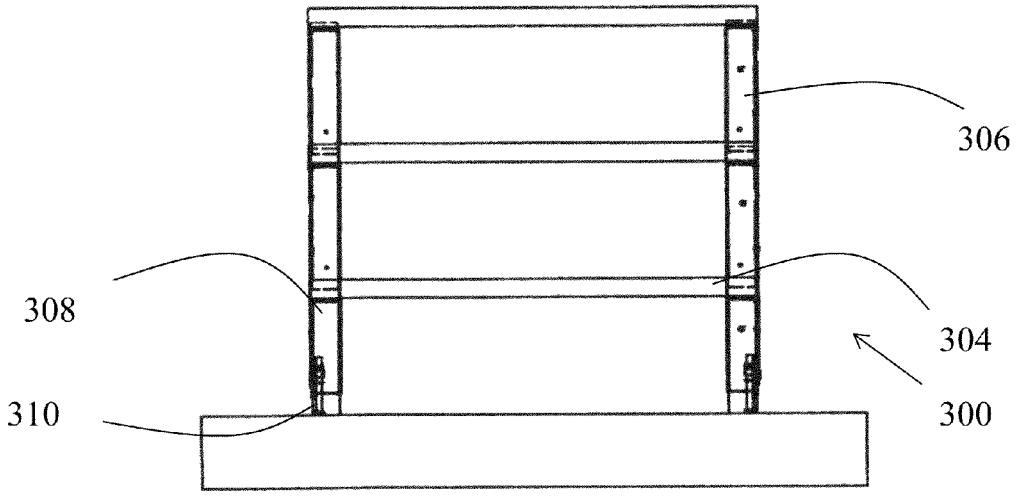
FIG. 3 is a front view of the device in use on a set of stairs.

FIG. 3 is a front view of the device in use on a set of stairs. The stringer cannot be seen, but stairs 300 have tread 304 which is held in place by tread support 306.

Figure 4:
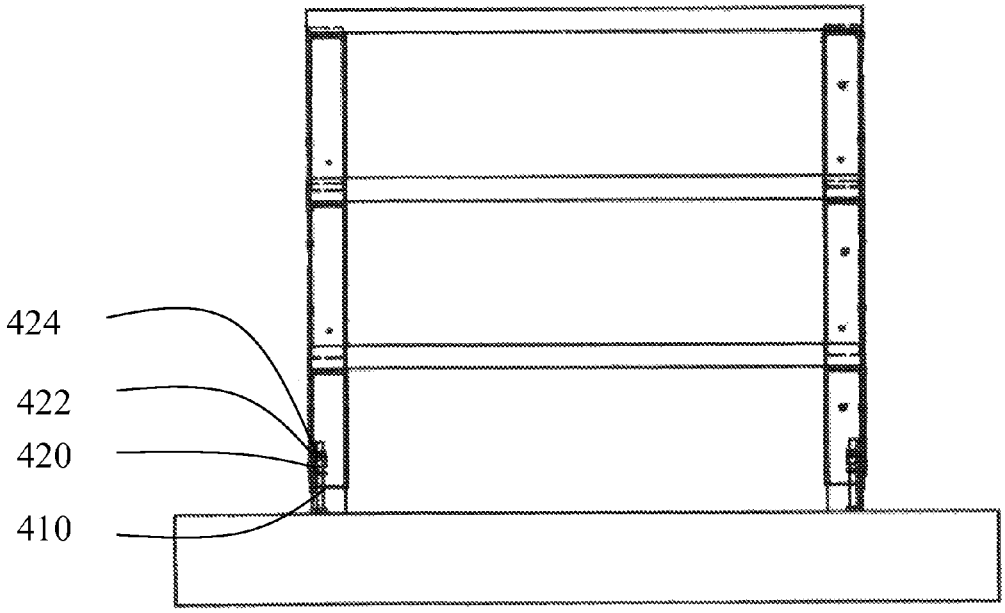
FIG. 4 is a front view of the device in use on a set of stairs, showing additional details of the bottom step.

Again, bottom tread support 308 has bottom bolt 310, and will be explained in greater detail in the next diagram. FIG. 4 is a front view of the device in use on a set of stairs.

Bottom bolt 410 passes twice through bottom bolt bracket 420 having bracket nut 422. It may then be tightened into place by means of jam nut 424.

Figure 5:
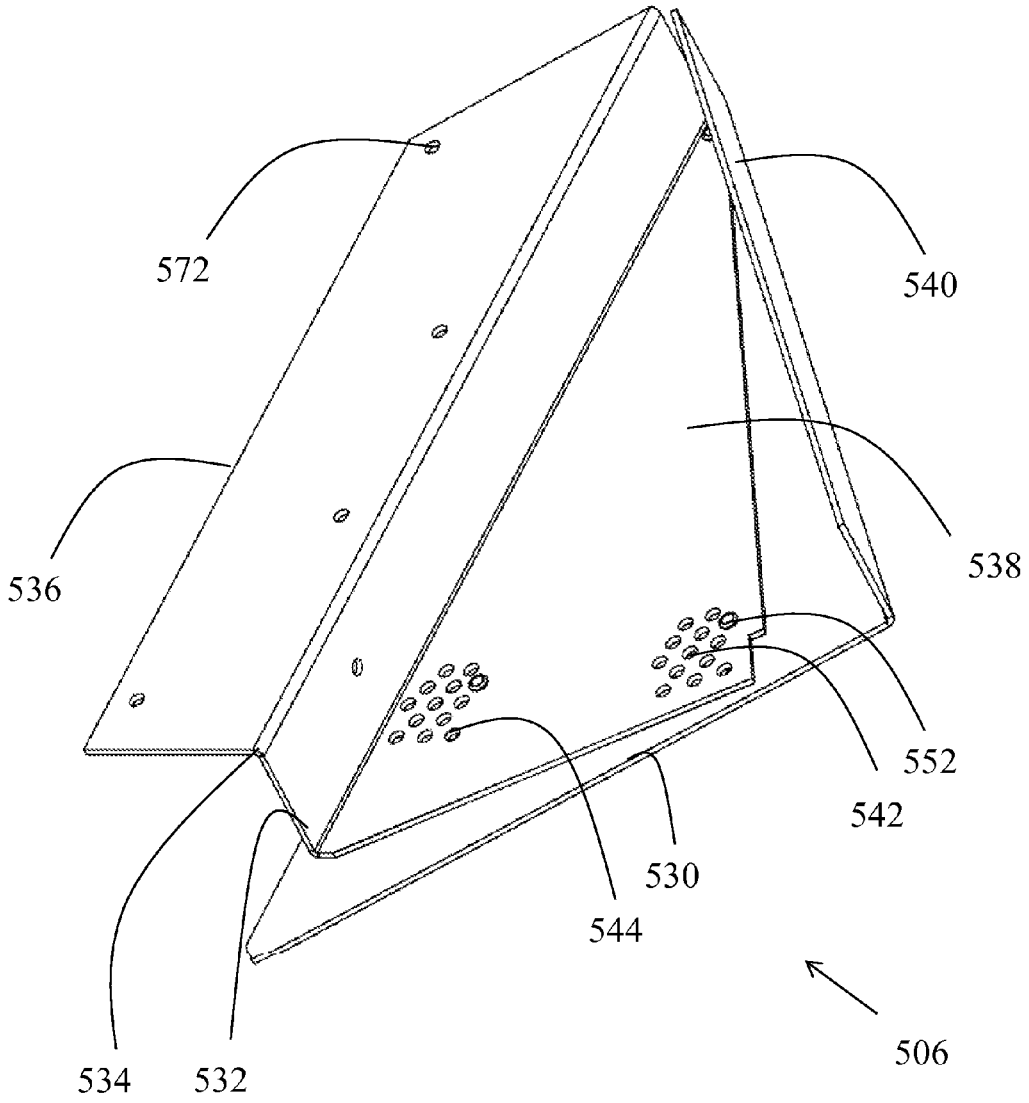
FIG. 5 is an oblique view of a first embodiment of the invention, in a right-handed sub-embodiment.

FIG. 5 is an oblique view of a first embodiment of the invention, in a right-handed sub-embodiment.

Tread support 506, the unit, has two major portions: tread support upper portion 530 and tread support lower portion 532.

Flat-to-stringer-support 534 is a flat area dimensioned and configured to engage flatly to the sloping top surface of a stringer, by which means weight of the stairs and weight on the stairs may be efficiently transferred to the stringer.

Side-of-stringer-support 536 is dimensioned and configured to engage flatly to the vertical side face of the stringer, and by means of numerous fastening points 572 (in this case, holes which allow screws, bolts or the like to be driven into or through the wooden stringer) allows for efficient fastening. Other fasteners may be used if they are safe and meet code, whether fasteners now known (rivets, nails) or later devised, however, in the present embodiment, certain fasteners are strongly preferred. Note that additional fastening points may be provided on other surfaces, such as flat-to-stringer-support surface 534, the flat-to-tread-support 540, etc.

Fin 538 protrudes above the rest of the lower part 532 and lays, coplaner, against matching parts of the upper part 530. The fin 538 has two groups of holes on it: fin holes group 1, 542, and also fin holes group 2, reference number 544. While one group is sufficient, a plurality of groups may optionally provide greater strength. The positioning of these holes is calculated and manufactured very precisely.

With one group, the weight on the tread, pressing down through upper part 530, is transmitted to lower part 532 and the stringer by way of one pivot 546 (preferably a rivet) and one fastener through the holes (preferably another rivet). A second group of holes (544) allows the addition of a third fastener for additional strength, conveniently located close to the riser end of the tread where maximum strength is usually needed.

Pivot 546 may seen in parts in later diagrams (FIG. 6, FIG. 9, FIG. 10) and comprises not just a rivet as an axle, but also pivot hole 1 (546*a*) and pivot hole 2 (546*b*), through the lower and upper parts of the device.

Upper portion holes group 1 (548) and upper portion holes group 2 (550) are very precisely precalculated and positioned. This is for the functioning of the invention. In particular, these holes must match very precisely with the matching hole groups 542 and 544 of the fin.

In usage, as the two parts of the invention are slowly pivoted relative to one another, the value of the rise height (the shape of the triangle) will change, increasing and decreasing, and the carefully positioned holes will have different pairs (one hole on the upper piece and one hole on the lower piece) come into a complete overlap at different times equating to different rise heights. By careful calculation and placement, these holes will provide a useful set of alignments, preferably every ⅛ inch, very precisely and yet without the need to do more than rotate the two parts to the correct amount.

Figure 6:
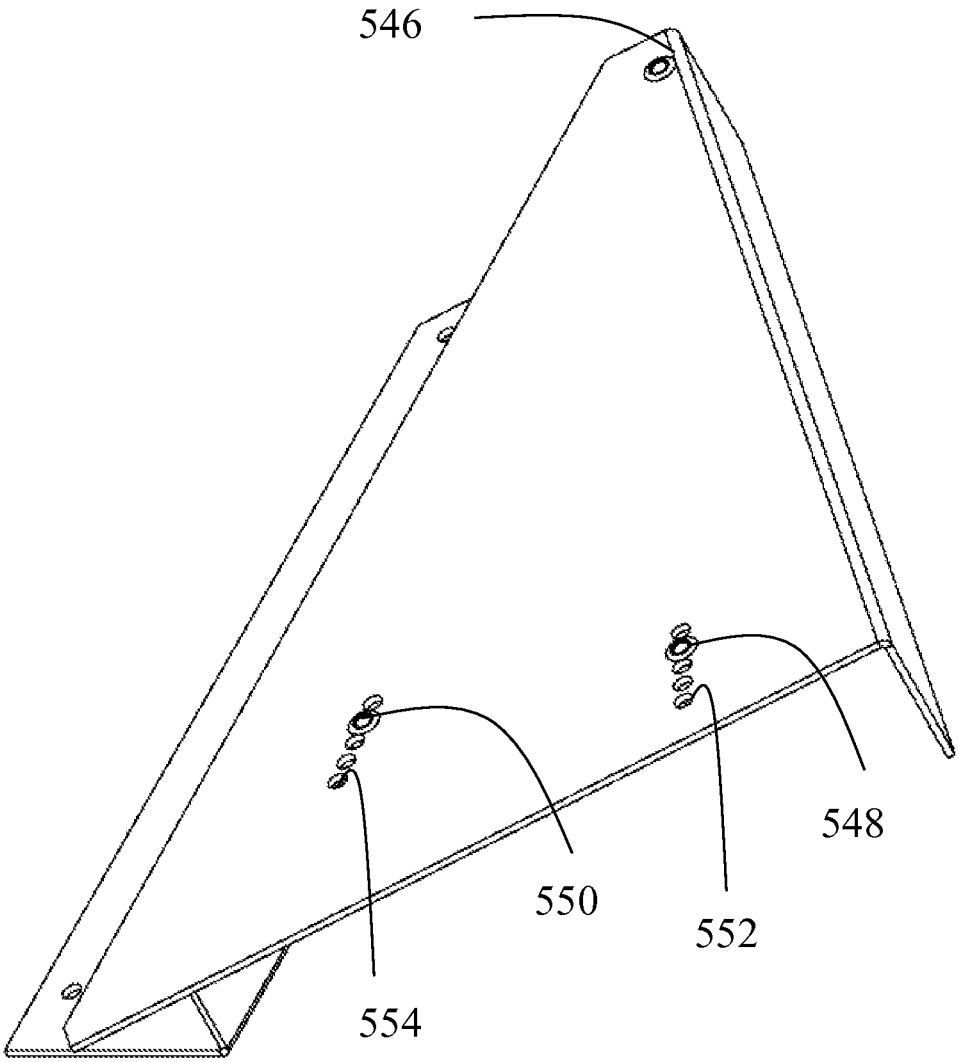
FIG. 6 is an oblique view of a first embodiment of the invention, in a left-handed embodiment.

After the correct riser height is achieved, the device is locked permanently into that shape. FIG. 6 is an oblique view of a first embodiment of the invention, in a left-handed embodiment, showing fastener (rivet) 552 and fastener (rivet) 554 passing through a pair of overlapping holes in this way. While the groups on the other part are arranged in several rows and in arcs, the groups 552/554 are on straight lines, which lines if extended will pass through the pivot 546.

Figure 7:
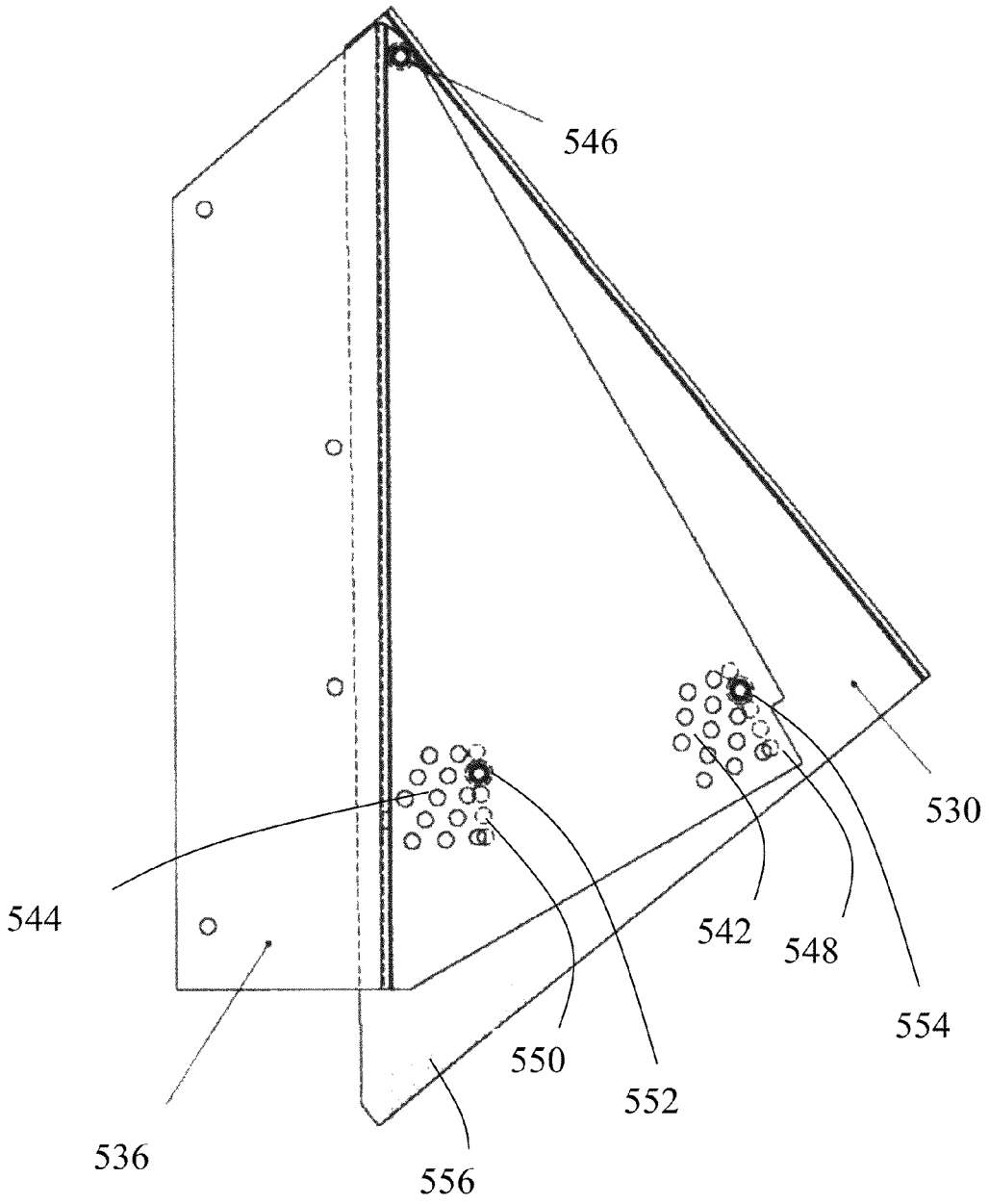
FIG. 7 is a transparent view of the first embodiment of the device in a right-handed embodiment.

This can be seen in transparency in FIG. 7, which is a transparent view of the first embodiment of the device in a right-handed embodiment. It will immediately be seen that rivets 552 and 554 are holding a pair of holes in alignment. Careful study of the diagram reveals that in transparency all four sets of holes are seen. Thus, at the top of group 544 of the fin, group 550 (a line) may be seen. Similarly, atop group 542 of the lower part, group 548 (another straight line) may be seen.

Alignment scale 556 is also clearly visible. An alignment scale such as 556 may be located at any convenient location on the device. Alignment scale 556 may align to an edge, a corner of one piece, a guide mark on the device, a notch on the device, etc.

This alignment scale greatly eases the use of the device. In particular, the indicia of the scale (lines as depicted, letters, numbers, holes, marks, painted or printed indicia, etc) may tell the builder/user exactly what value of riser height is set in when a given indicia or alignment mark matches some external object, such as the top of the stringer, the top of the riser below, a matching pointer on the other half, etc. Thus a user desiring a 7½" inch step would simply slide the device to 7½" indicator of the alignment guide. At that point, one pair of holes would be clearly overlapping and in alignment, rather than blocked or partially occluded. That aligned pair of holes would be visible to the user, who would then slide the fastener (a rivet, bolt, or other device now known or later developed) through and then secure it, for example by popping the rivet in or tightening a nut onto a bolt.

At the present time rivets are the preferred embodiment rather than bolts or the like, for the purpose of securing the holes in the desired configuration, while screws and bolts are preferred for fastening to the stringer.

Figure 8:
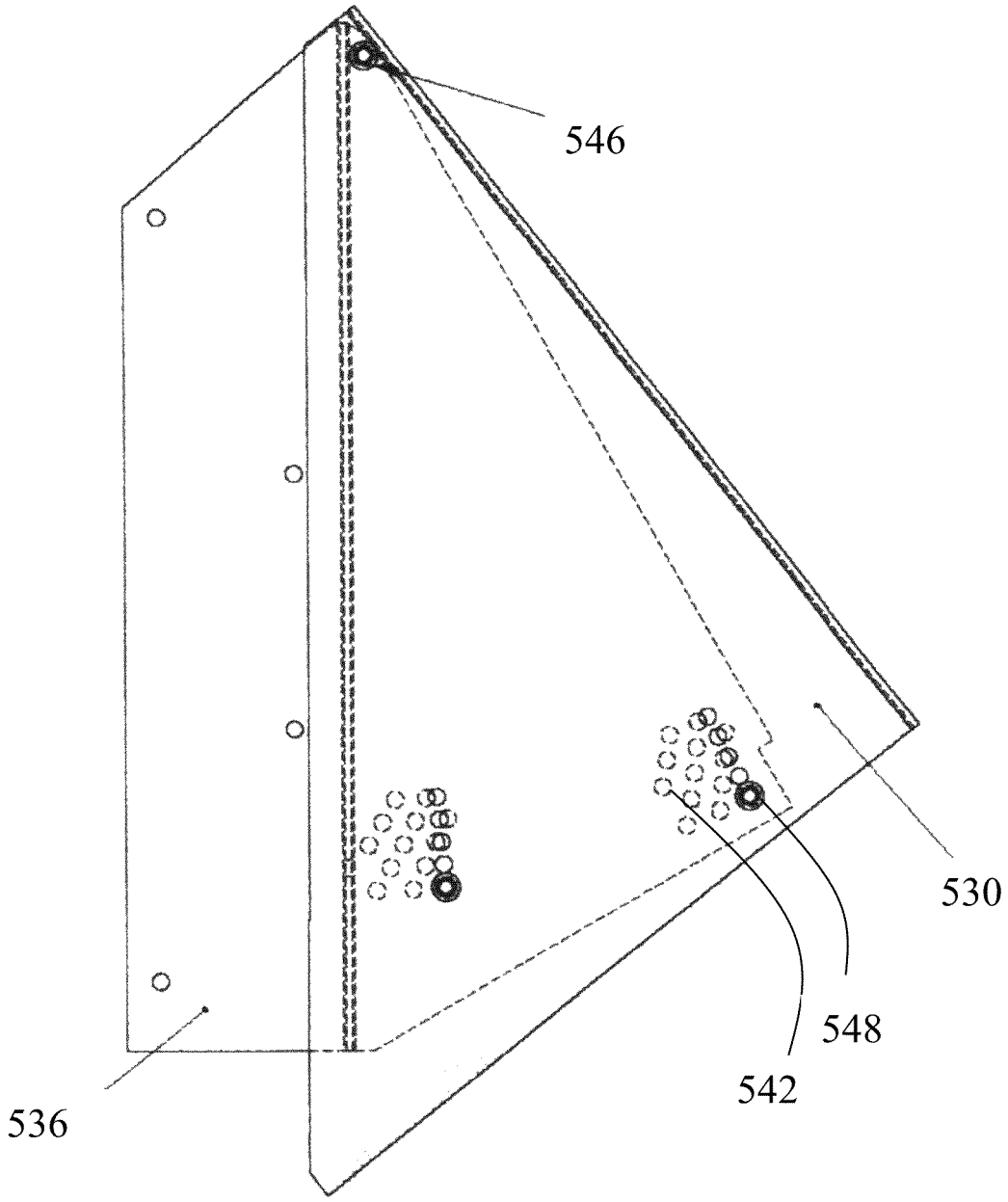
FIG. 8 is a transparent view of the first embodiment of the device in a left-handed embodiment.

FIG. 8 is a transparent view of the first embodiment of the device in a left-handed embodiment. This diagram at first sight appears identical to FIG. 7, but in fact it is a view of the matching device having the opposite handedness.

Figure 9:
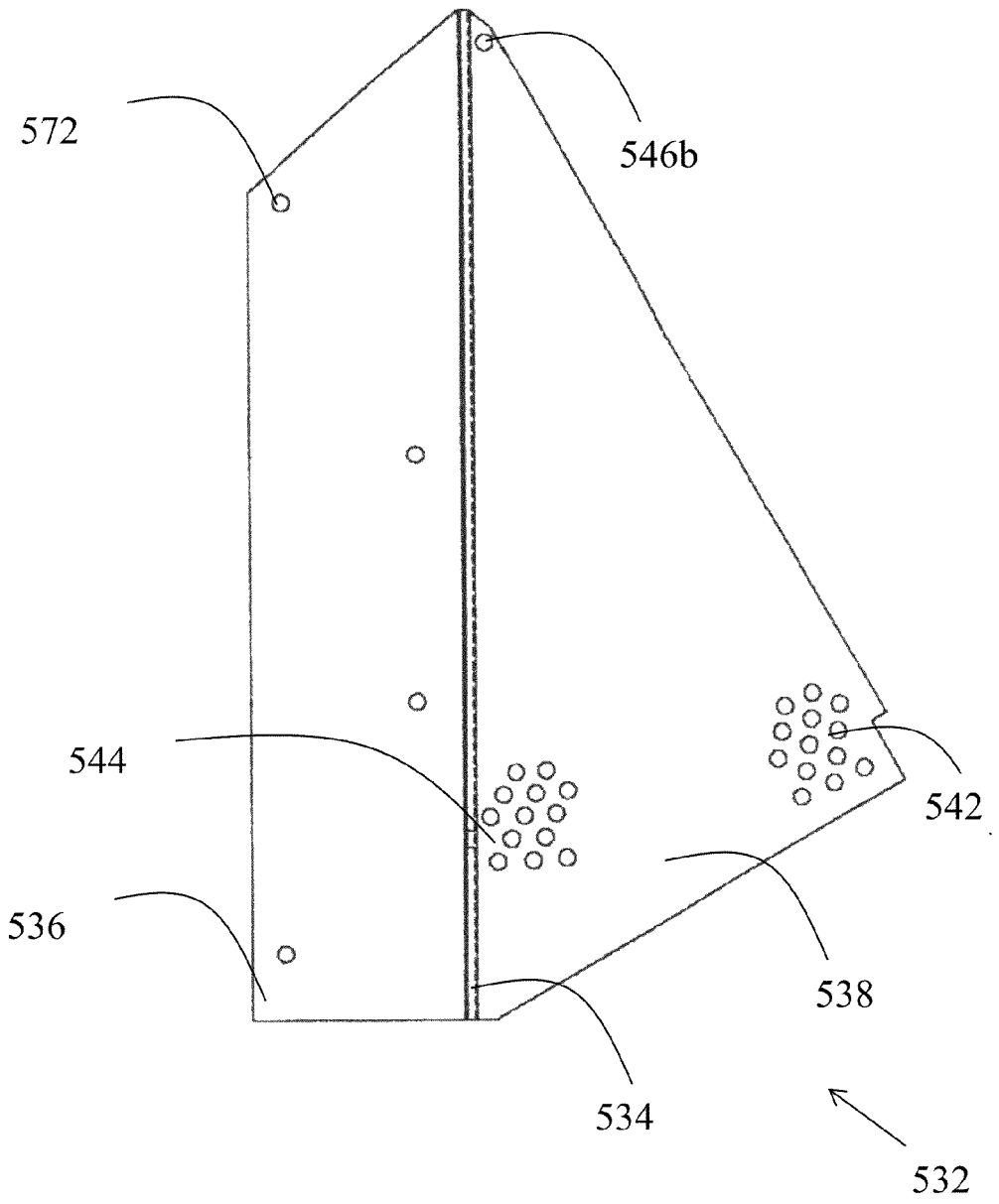
FIG. 9 is a transparent side view of the lower portion of the device's first embodiment.
Figure 10:
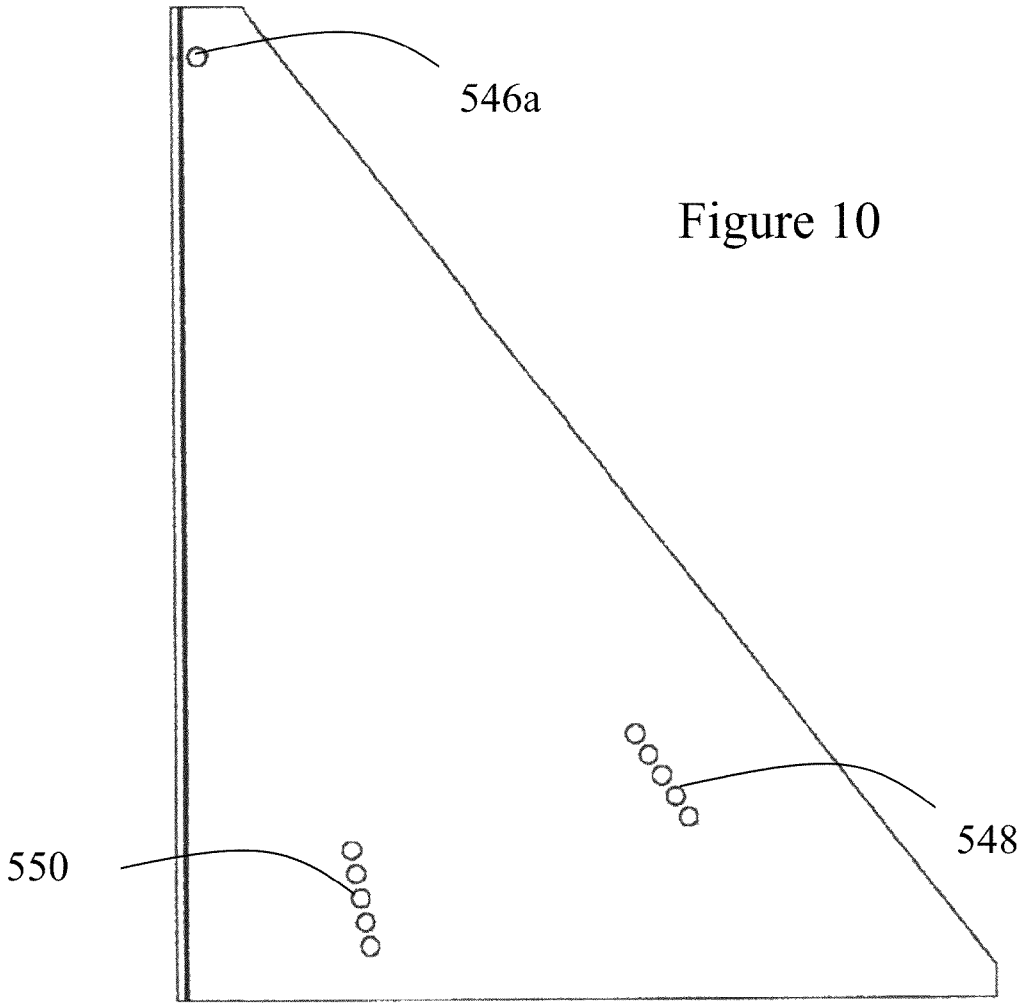
FIG. 10 is a side view of the upper portion of the device's first embodiment.

FIG. 9 is a transparent side view of the lower portion of the device's first embodiment. This is shown without the upper portion for additional clarity, while FIG. 10 is a side view of the upper portion of the device's first embodiment, shown without the lower portion for additional clarity.

Figure 11:
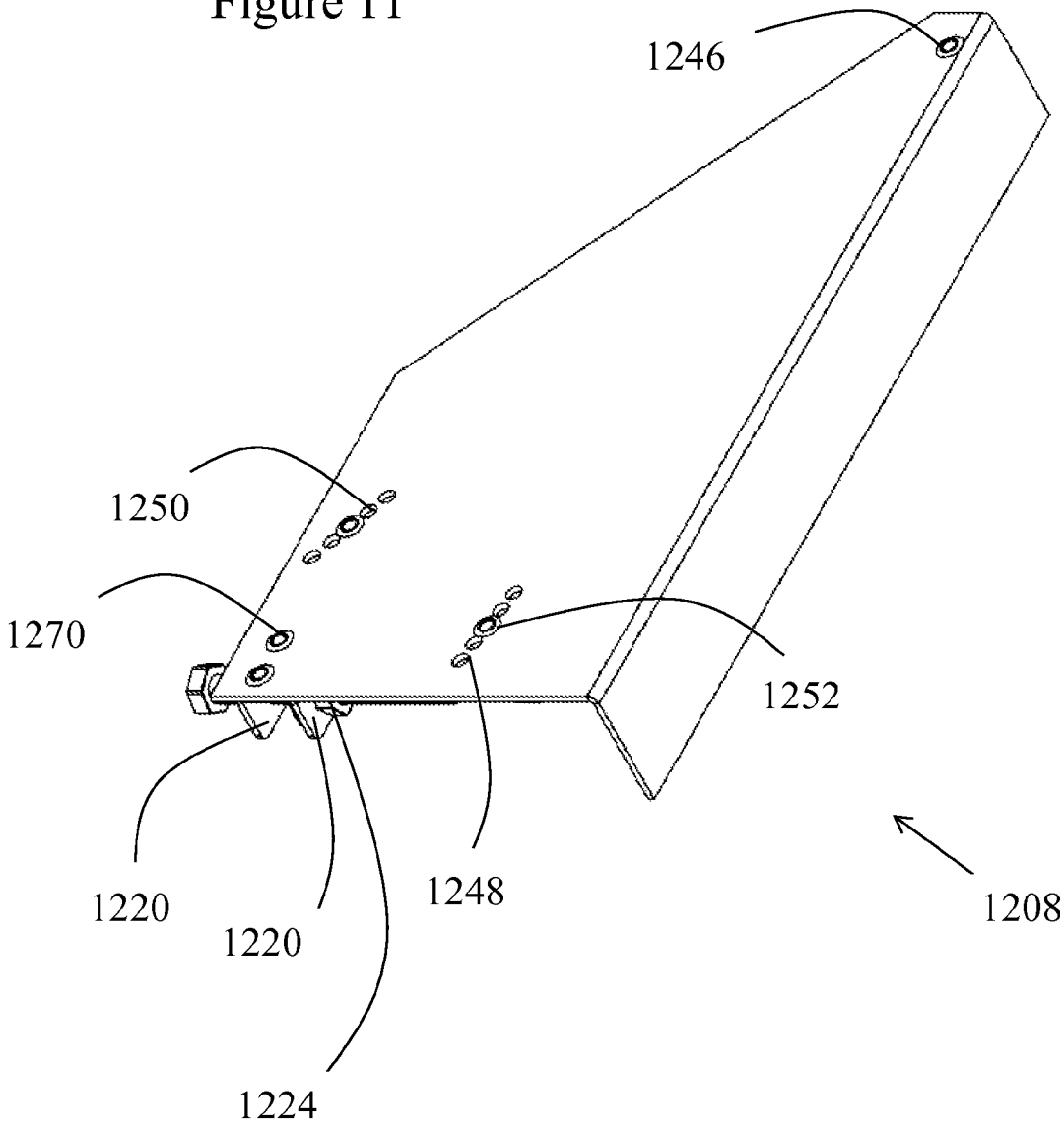
FIG. 11 is an oblique view of the second embodiment in a left-handed sub-embodiment for the bottom step.
Figure 12:
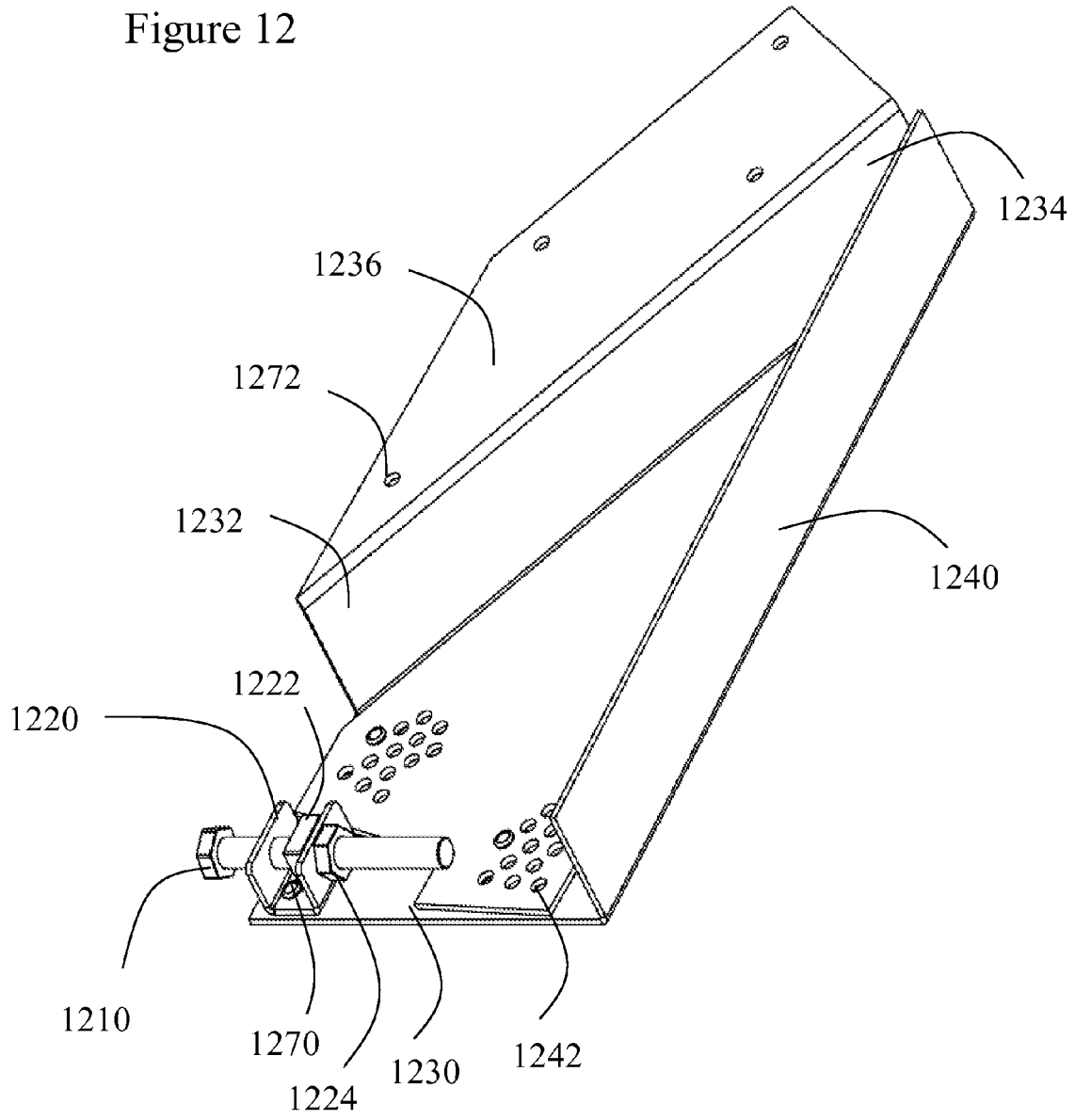
FIG. 12 is an oblique view of the second embodiment in a right-handed sub-embodiment for the bottom step.

FIG. 11 is an oblique view of the second embodiment in a left-handed sub-embodiment, while FIG. 12 is an oblique view of the second embodiment in a right-handed sub-embodiment.

Figure 13:
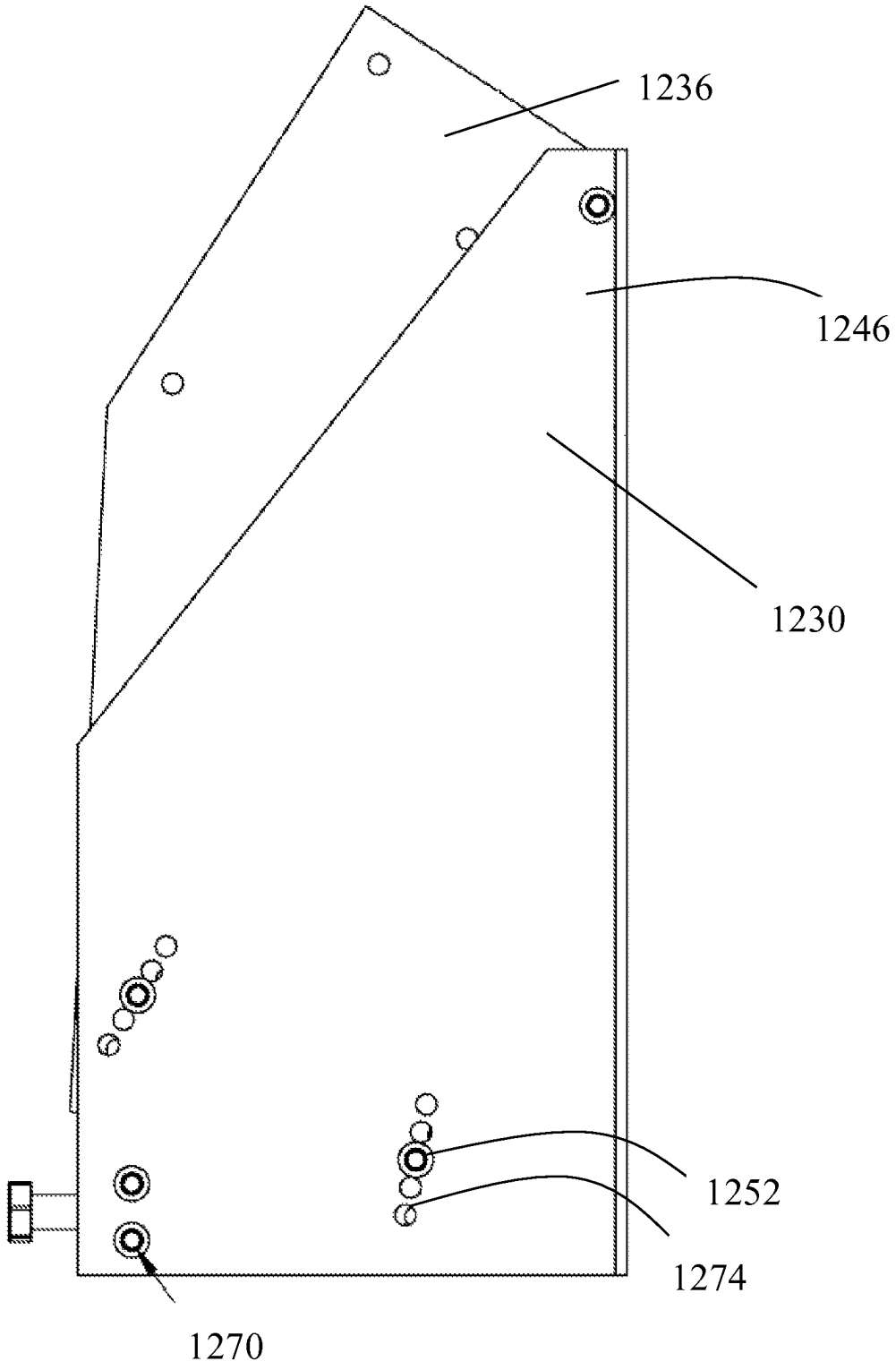
FIG. 13 is a side view of the second embodiment of the invention, left-handed.
Figure 14:
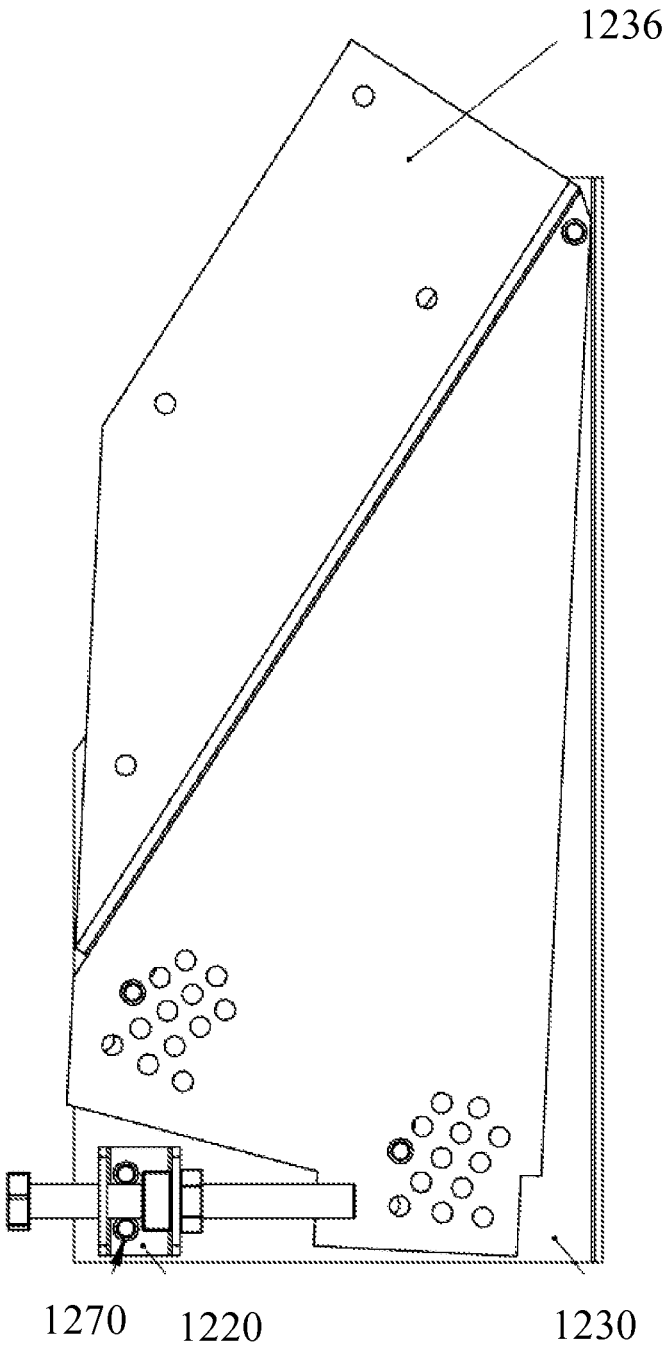
FIG. 14 is a side view of the second embodiment of the invention, right-handed.

FIG. 13 is a side view of the second embodiment of the invention, left-handed, while FIG. 14 is a side view of the second embodiment of the invention, right-handed.

As discussed previously, this second embodiment is useful or necessary for the bottom-most step in a set of stairs. Adverting back to FIG. 1, it is obvious that the stringer physically cannot extend as far under the lowest step as it does for other steps higher up: the ground intervenes. This situation is very common in real building situations. Thus the second embodiment tread support 1208 is necessary in order to create a complete system of stairs.

Bottom bolt 1210 passes through bottom bolt bracket 1220 which is physically secured to the bottom part 1232. Bracket nut 1222 and jam nut 1224 serve to lock the bolt 1210 in place and prevent it from rotating during use.

Note that the single square nut is advantageous for diverse reasons, including fit to the bracket, ease of use and so on.

Tread support upper portion 1230 and tread support lower portion 1232 do however have most of the same configurations as in the previously discussed embodiment.

Flat-to-stringer-support 1234 effectively transfers weight to the stringer while side-of-stringer-support 1236 provides efficient location of fasteners, such as at fastening point 1272.

Flat-to-tread support 1240 provides a flat surface for the tread to rest upon, fin holes group 1 (1242) match with upper portion holes group 1 (1248).

Pivot 1246 and pivot hole 1 1246*a* may be seen, as may fastener (rivet) 1252 and fastener (rivet) 1270. Fastener 1270 and fastener hole 1 (1270*a*) actually serve to secure the bolt bracket to the device as a whole.

Partially occluded hole 1274 (FIG. 13) is provided to illustrate how the device is used and how it appears in use. The hole having the fastener 1252 may be seen through, unoccluded. Other holes are blocked, or in the case of hole 1274, partially eclipsed. Thus a builder has a quite easy time once they have lined up the alignment guide, in deciding which hole is proper for their needed elevation change. While the alignment guide is not shown on this embodiment, alternative alignment guides may be used. In practical terms, alignment for the bottom step may be accomplished by matching the same holes used for other steps supports (which do have guides). In even more practical terms, the bottom step has the bottom bolt 1210 which is adjustable, so at final installation the builder will simply adjust the bolt properly in any case.

Figure 17:
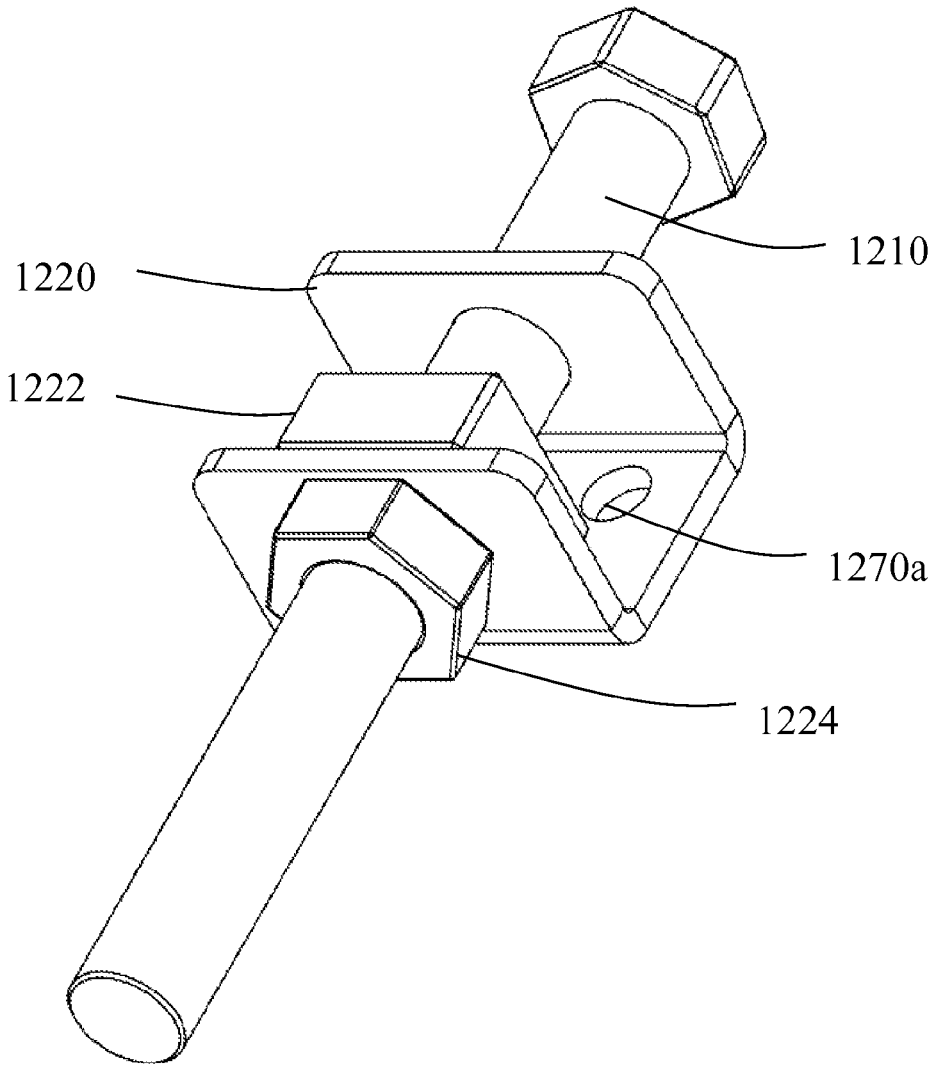
FIG. 17 is an oblique view of the bottom bolt assembly of the invention.
Figure 18:
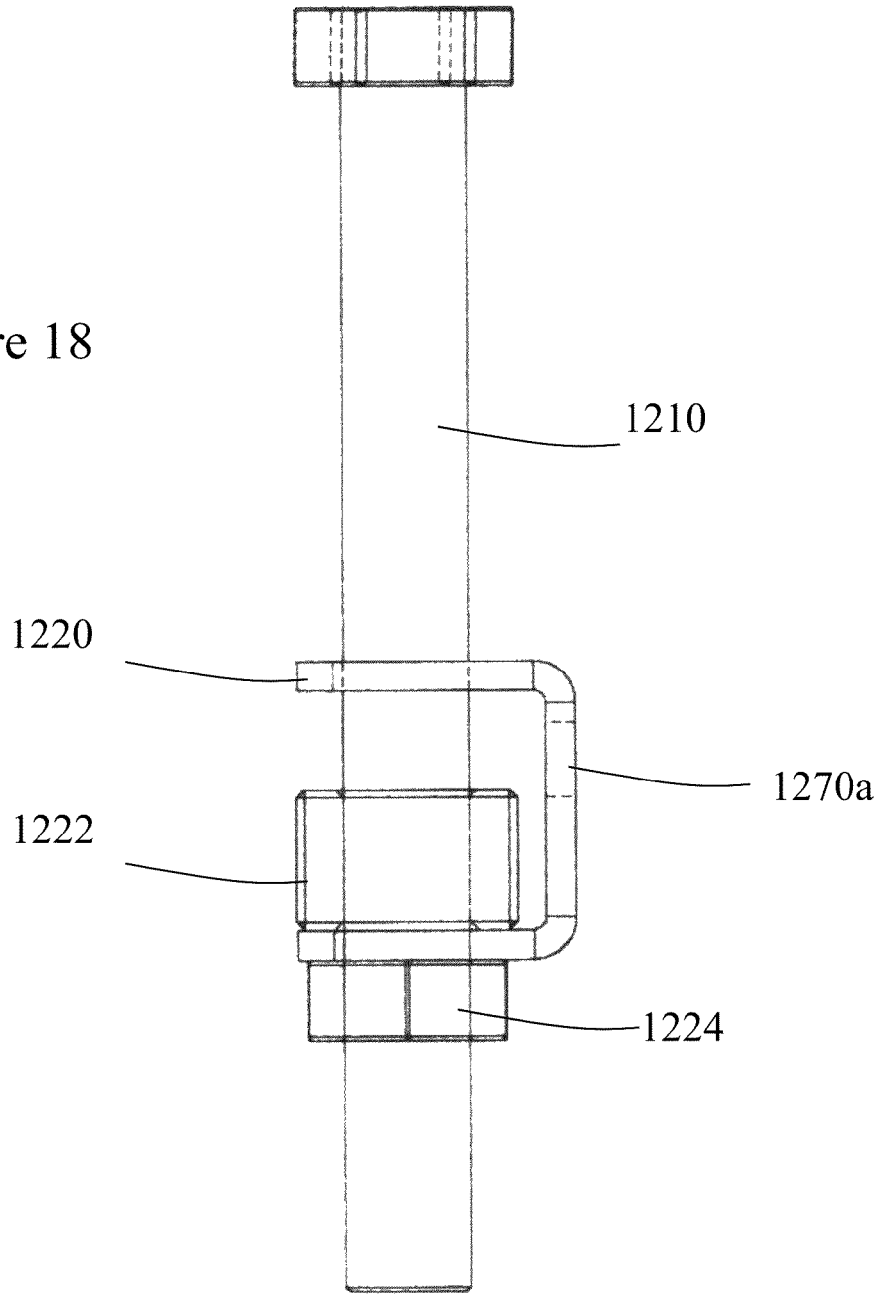
FIG. 18 is a transparent side view of the bottom bolt assembly of the invention.

FIG. 15 is a front view of the second embodiment of the invention, left-handed, FIG. 16 is a side view of the second embodiment of the invention, right-handed. Bolt 1210, bracket 1220, the upper and lower parts 1230/1240 and so on may be seen. FIG. 17 is an oblique view of the bottom bolt assembly of the invention, while FIG. 18 is a transparent side view of the bottom bolt assembly of the invention. Again, the locking nut 1224 (jam nut) and bracket nut 1222 obviously cooperate to easily secure bolt 1210. Fastener hole 1270*a* is more clearly visible.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A stairway tread support device for use on a set of stairs, the tread support device comprising:

a pivot point;

a first lower part, the lower part having a vertical fin;

a second upper part, the upper part and the lower part pivoting relative to one another about the pivot point;

a first riser height H measured at a first edge of the device distal from the pivot point, the riser height H having a plurality of values;

a first plurality of holes passing through the fin of the lower part;

a second plurality of holes passing through the upper part;

a first pair of holes including a first hole of the first plurality of holes and a second hole of the second plurality of holes which are overlapping when the riser height H is a first riser height $H_1$;

the first and second plurality of holes arranged so that as the riser height H increases by a first increment X from $H_1$ to a riser height $H_2$, the first pair of holes are no longer overlapping and a second pair of holes including a third hole of the first plurality of holes and a fourth hole of the second plurality of holes do overlap;

a fastener dimensioned and configured to pass through the overlapping pairs of holes and disposed within an overlapping pair of holes;

a second tread support device, the second tread support device having a second tread support device pivot point;

a second tread support device lower part, the second tread support device lower part having a second tread support device vertical fin;

a second tread support device upper part, the second tread support device upper part and the second tread support device lower part pivoting relative to one another about the second tread support device pivot point;

a second tread support device first riser height H measured at a second tread support device second edge distal from the second tread support device pivot point, the second tread support device riser height H having a plurality of values;

a second tread support device first plurality of holes passing through the second tread support device fin of the second tread support device lower part;

a second tread support device second plurality of holes passing through the second tread support device upper part;

a third pair of holes including a fifth hole of the second tread support device first plurality of holes and a sixth hole of the second tread support device second plurality of holes which are overlapping when the second tread support device riser height H is the first riser height $H_1$;

the second tread support device first and second plurality of holes arranged so that as the second tread support device riser height H increases by the first increment X from $H_1$ to the riser height $H_2$, the third pair of holes are no longer overlapping and a fourth pair of holes including a seventh hole of the second tread support device first plurality of holes and an eighth hole of the second tread support device second plurality of holes do overlap;

a second fastener dimensioned and configured to pass through the overlapping pairs of holes of the second tread support device and disposed within an overlapping pair of holes;

the second tread support device further comprising:

a height adjustment mechanism separate from the pluralities of holes, the height adjustment mechanism providing a second independent adjustment to the riser height H of the second tread support device, the height adjustment mechanism located on the second tread support device second edge;

the second edge being shorter than the first edge.

2. A set of stairs including the tread support device of claim 1, the set of stairs further comprising:

a stringer, the stringer supported at a first end and at a second end, the first end higher than the second end, the stringer having a top surface disposed at an angle due to the first end being supported higher than the second end, the stringer having a side surface;

the tread support device disposed upon the top surface, the first lower part fastened to the stringer, the fastener disposed through the first pair of holes such that the riser height H has the value $H_1$;

a tread, the tread disposed upon the second upper part of the tread support device, the tread fastened to the second upper part.

3. The tread support device of claim 2, wherein the lower part further comprises a flat-to-stringer-support portion, the flat-to-stringer-support portion disposed upon the stringer top.

4. The tread support device of claim 3, wherein the lower part further comprises a side-of-stringer-support portion, the side-to-stringer-support portion disposed upon the stringer side.

5. The tread support device of claim 3, wherein the flat-to-stringer-support portion further comprises: a fastening hole allowing fastening of the tread support device to the stringer.

6. The tread support device of claim 2, wherein the upper part further comprises a tread support part, the tread support part having the tread disposed thereon and fastened thereto.

7. The tread support device of claim 1, wherein the increment X is ⅛ inch (3 mm).

8. The tread support device of claim 1, wherein the height adjustment mechanism further comprises:

a bolt, secured to the second tread support device second edge with the bolt parallel to the second edge, whereby a step is additionally supported.

9. The tread support device of claim 8, wherein the bolt is secured to the second edge by passing through a bracket attached to the second tread support device lower part, the bolt passing through a bracket nut attached to the bracket and further passing through a jam nut, whereby the bolt is locked in place.

10. The tread support device of claim 1, wherein the second plurality of holes on the upper part are arranged in a first pivot line, the first pivot line passing through the pivot point, while the first plurality of holes on the lower part are arranged in a group, the group not confined to the first pivot line.

11. The tread support device of claim 1, wherein the pivot point further comprises:

a rivet.

12. The tread support device of claim 1, wherein the fastener further comprises: a rivet.

13. The tread support device of claim 1, wherein the first edge further comprises:

an alignment guide, the alignment guide having a series of markings, the series of markings bearing indicia indicating the value of the riser heights $H_1$ and $H_2$, measured to the nearest increment X.

14. The tread support device of claim 13, wherein the alignment guide is sufficiently accurate that when riser height $H_1$ is indicated, the overlap of the first and second holes is visible and the first and second holes overlap, and when riser height $H_2$ is indicated, the overlap of the third and fourth holes is visible and the third and fourth holes overlap;

whereby the overlap is sufficiently accurate that the fastener may pass through the visibly overlapping holes.

* * * * *